US005603539A

United States Patent [19]

Gruhn et al.

[11] Patent Number: 5,603,539

[45] Date of Patent: Feb. 18, 1997

[54] MOTOR-VEHICLE DOOR LATCH WITH EXCHANGEABLE LOCK LINKAGE

[75] Inventors: Klaus Gruhn, Mönchengladbach; Frank Kleefeldt, Heiligenhaus; Johannes-Theodor Menke, Velbert, all of Germany

[73] Assignee: Kiekert Aktiengesellschaft, Heiligenhaus, Germany

[21] Appl. No.: 509,003

[22] Filed: Jul. 28, 1995

[30] Foreign Application Priority Data

Sep. 1, 1994 [DE] Germany ..... 44 31 144.3
Dec. 10, 1994 [DE] Germany ..... 44 44 048.0

[51] Int. Cl.[6] ..... E05C 3/16

[52] U.S. Cl. ..... 292/216; 292/199; 70/237

[58] Field of Search ..... 292/216, 195, 292/199; 70/190, 237, 264

[56] References Cited

U.S. PATENT DOCUMENTS

| | | | |
|---|---|---|---|
| 4,735,447 | 4/1988 | Kleefeldt | 292/216 |
| 4,793,640 | 12/1988 | Stewart, Sr. | 292/201 |
| 4,948,183 | 8/1990 | Yamada | 292/199 |
| 5,106,135 | 4/1992 | Menke et al. | 292/216 |
| 5,476,294 | 12/1995 | Menke | 292/216 |
| 5,494,322 | 2/1996 | Menke | 292/216 |

*Primary Examiner*—Steven N. Meyers
*Assistant Examiner*—Donald J. Lecher
*Attorney, Agent, or Firm*—Herbert Dubno; Andrew Wilford

[57] ABSTRACT

A door latch has a main housing holding latching element that can retain it in a latched or an unlatched position. A manual actuating mechanism is movable in the main housing between actuated and unactuated positions and a coupling part on the main housing can move between a coupling position connecting the actuating mechanism to the latching elements for displacement of them into the unlatched position on displacement of the actuating mechanism into the actuated position and a decoupling position for disconnecting the actuating mechanism from the latching elements. A central locking element on the main housing is movable between locked and unlocked positions and a locking mechanism jointly movable with the locking element can displace the coupling part into the decoupling position on displacement of the central locking element into the locked position and for displacing the coupling part into the coupling position on displacement of the central locking element into the unlocked position. One mechanism has an externally accessible actuation formation and an auxiliary housing independent of the main housing holds a linkage having a pair of ends and is secured on the main housing with one end of the linkage fitted to the actuation formation for operation of the one mechanism via the actuation formation and with the other end of the linkage positioned for connection to an actuating part.

11 Claims, 4 Drawing Sheets

MOTOR-VEHICLE DOOR LATCH WITH EXCHANGEABLE LOCK LINKAGE

FIELD OF THE INVENTION

The present invention relates to a motor-vehicle door latch. More particularly this invention concerns such a latch which also has a locking function.

BACKGROUND OF THE INVENTION

A motor-vehicle door latch normally has a housing, a lock fork on the housing engageable with a door bolt and pivotable between a holding position engaged around the bolt and retaining it on the housing and a freeing position permitting the door bolt to move into and out of the housing, and a release pawl engageable with the fork and displaceable between a latched position retaining the fork in the holding position and an unlatched position unengageable with the fork and permitting the fork to move into the freeing position. An actuating mechanism is movable between an actuated position and an unactuated position and normally has an inside and an outside actuating lever connected to respective door handles. A coupling part is displaceable on the housing between a coupling position connecting the actuating mechanism to the release pawl for displacement of the release pawl into the unlatched position on displacement of the actuating mechanism into the actuated position and a decoupling position for disconnecting the actuating mechanism from the release pawl. Thus in the decoupling position operation of the actuating mechanism does not affect the release pawl. A central locking element is displaceable on the housing between locked and unlocked positions and is connected via a locking mechanism normally also operable by at least an inside locking element with the coupling part for displacing the coupling part into the decoupling position on displacement of the central locking element into the locked position and for displacing the coupling part into the coupling position on displacement of the central locking element into the unlocked position.

Thus such a latch, when used on for example on a front vehicle door, is connected to four different things: the inside locking element which typically is a button or small lever, the outside locking element which is normally a key-operated cylinder, and inside and outside latching handles. The latch mechanism can be operated by the inside handle when it is locked and in many systems the inside handle can also be disconnected in the locked position of the latch.

In commonly owned U.S. Pat. No. 4,735,447 the vehicle door latch for use in combination with a door bolt has an outer housing part formed with a recess in which the bolt is receivable and is provided with the latch fork and with a latch pawl pivotal on the outer housing part into and out of a position retaining the fork in the locked position. A middle housing part lying on the outer housing part carries the latching mechanism connected to the pawl for moving same into and out of its position retaining the fork in the locked position. The locking mechanism connected to the latching mechanism prevents same from operating the pawl to latch the fork, and the locking and opening levers respectively connected to the locking and latching mechanisms and connectable respectively to the outside door lock and outside door handle operates the respective mechanisms. An inner housing part lying on the middle housing part carries respective locking and opening links connected to the locking and latching mechanisms for operating same and a servomotor is connected to the locking mechanism for operating same and preventing operation of the latching mechanism by the opening link and lever. Fasteners secure the parts to contain the mechanisms and servomotor.

While such a latch is an excellent system for use on a front vehicle door, it is less suitable for use on a rear door or on a trunk lid. The rear doors are not usually provided with outside locking connections, that is the only way to unlock the rear doors is from inside the vehicle. Thus any connection for an outside lock element is superfluous on a rear-door latch. In addition when such a lock is provided on a trunk lid, where an outside locking cylinder and inside mechanical latching connection are provided, the orientation of the cylinder relative to the lock is frequently greatly different from that used on a front vehicle door. Thus separate locks must be built for the rear doors and trunk lid.

OBJECTS OF THE INVENTION

It is therefore an object of the present invention to provide an improved motor-vehicle door latch.

Another object is the provision of such an improved motor-vehicle door latch which overcomes the above-given disadvantages, that is which can readily be adapted for use on any of the doors—front, back, and trunk—of a motor vehicle.

A further object is to provide an improved motor-vehicle door latch which can readily be adapted to doors of different geometries.

SUMMARY OF THE INVENTION

A motor-vehicle door latch has according to the invention a main housing, a lock fork on the main housing engageable with a door bolt and pivotable between a holding position engaged around the bolt and retaining it on the main housing and a freeing position permitting the door bolt to move into and out of the main housing, and a release pawl engageable on the main housing with the fork and displaceable between a latched position retaining the fork in the holding position and an unlatched position unengageable with the fork and permitting the fork to move into the freeing position. A manual actuating mechanism is movable in the main housing between an actuated position and an unactuated position and a coupling part on the main housing can move between a coupling position connecting the actuating mechanism to the release pawl for displacement of the release pawl into the unlatched position on displacement of the actuating mechanism into the actuated position and a decoupling position for disconnecting the actuating mechanism from the release pawl so that in the decoupling position actuation of the actuating mechanism does not affect the release pawl. A central locking element on the main housing is movable between a locked and an unlocked position and a locking mechanism jointly movable with the locking element is connected between the central locking element and the coupling part for displacing the coupling part into the decoupling position on displacement of the central locking element into the locked position and for displacing the coupling part into the coupling position on displacement of the central locking element into the unlocked position. One of the mechanisms is provided with an externally accessible actuation formation and an auxiliary housing independent of the main housing holds a linkage having a pair of ends and is secured on the main housing with one end of the linkage fitted to the actuation formation for operation of the one mechanism via the actuation formation and with the other end of the linkage positioned for connection to an actuating part.

Thus this lock can readily be adapted to operation by different actuating handles, lock cylinders, and the like. Normally the one mechanism is the locking mechanism and the actuating part serves for connection of an externally operable key cylinder. Thus if an external key cylinder is not needed, for instance on a rear vehicle door, the auxiliary housing and its linkage can be dispensed with altogether. Alternately if the cylinder is variously spaced from the latch, different auxiliary housings and linkages can be provided to make the fit.

The other end of the linkage in accordance with this invention is formed by a rotatable nut. This nut can be toothed to fit over or in an end of a cylinder or can have a standard butterfly-section seat for receiving a flat lock stem with some angular play.

According to the invention the actuating part is a lock cylinder. The housings have interfitting mounting formations forming the securing means. More particularly one of the formations is a dovetail projection and the other a dovetail groove. Furthermore the one end of the linkage fits complementarily with the actuation formation and the linkage is a gear train. The actuation formation is a noncylindrical shaft part projecting from the main housing and the one linkage end is shaped to fit complementarily over the shaft part.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
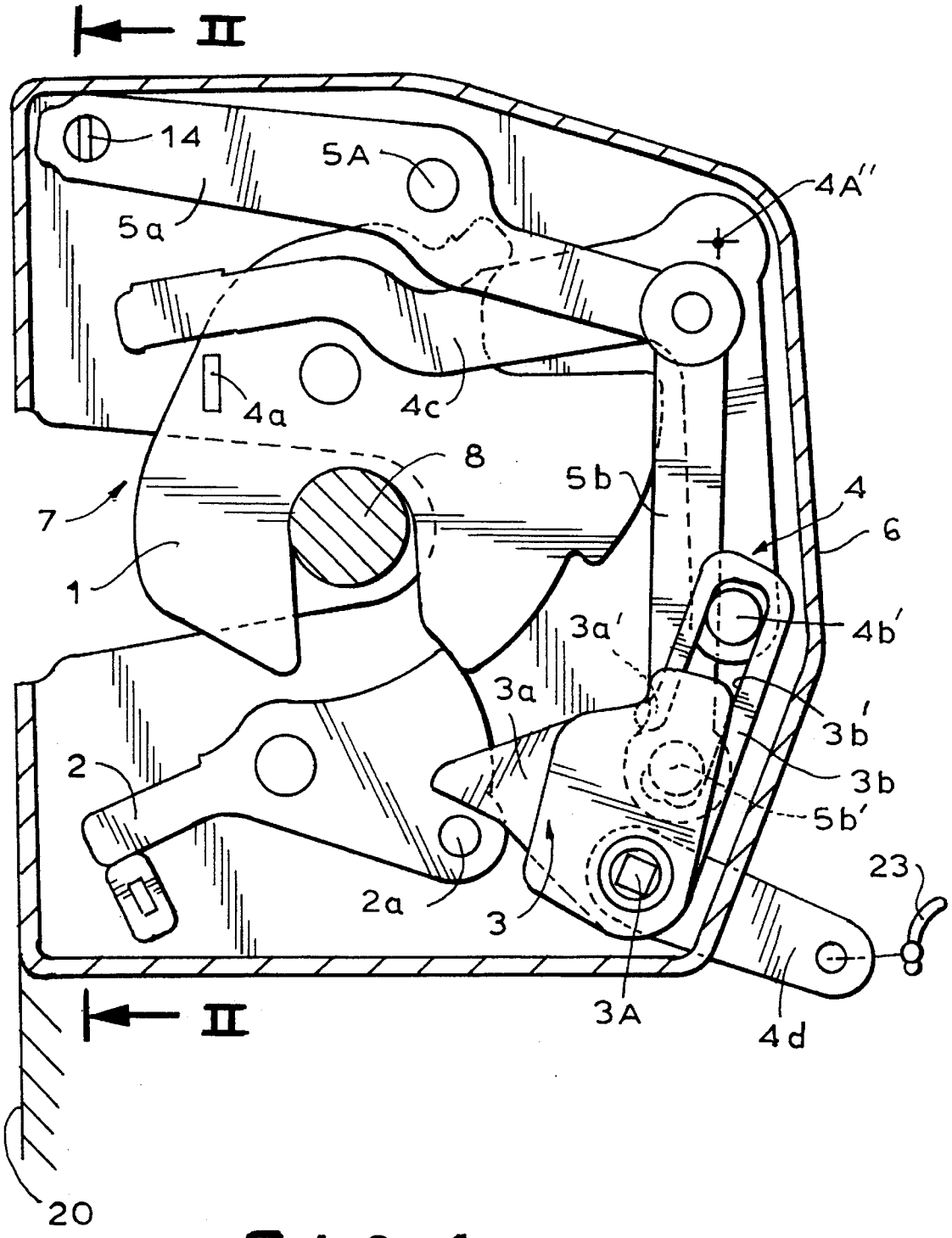
FIG. 1 is a partly diagrammatic vertical section through a door latch according to the invention.
Figure 2:
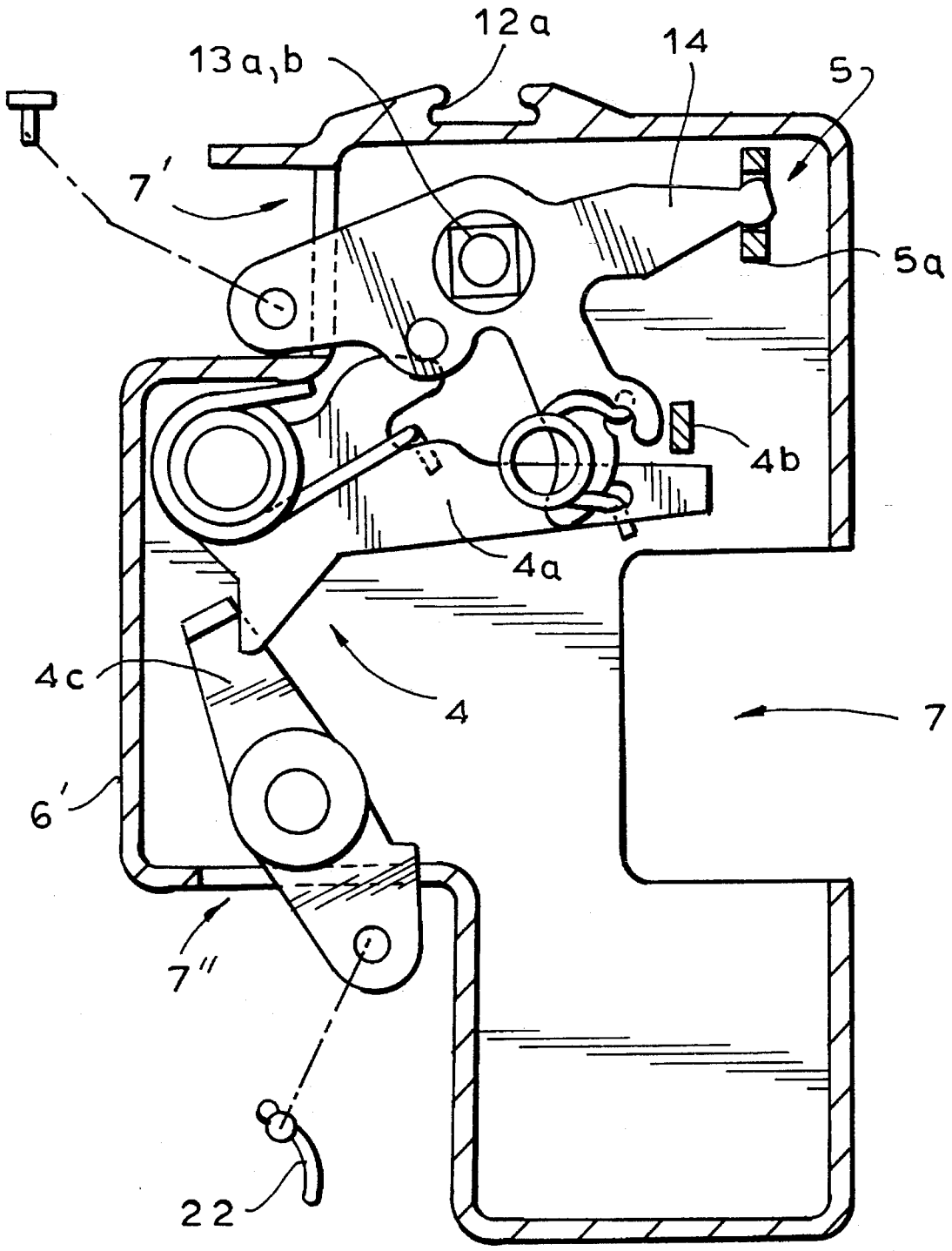
FIG. 2 is a section taken along line II—II of FIG. 1.

As seen in FIGS. 1 and 2 a latch according to the invention has a housing 6 which is mounted on an edge of a door illustrated schematically at 20 and formed with a main cutout 7 in which a fork 1 is pivotal so as to trap and hold a bolt 8 extending from an unillustrated door post. A pawl 2 carrying an actuating pin 2*a* can secure the fork 1 in the illustrated holding position or can be pivoted to allow the fork 1 to pivot clockwise and release the bolt 8.

The housing 6 contains a release-lever system 3, a latching/unlatching lever system 4, and a locking lever system 5. More particularly it carries a release lever 3*a* pivotal about an axis 3A, a guide 3*b* also pivoted on this axis 3A, a lever 5*a* pivoted about another parallel axis 5A, a link 5*b* pivoted on an end of the lever 5*a*, and an L-shaped lever 4*b* pivoted at an axis 4A on the housing 6. The lever 4*b* is acted on by a lever 4*a* intended to move the latch between the latched and unlatched positions, respectively retaining and releasing the bolt 8. The lever 5*a* is acted on by an inside locking lever 14 that displaces it between a locked and unlocked position. In the locked position, actuation of the lever 4*b* by the locking lever 4*a* is not effective to release the bolt. Virtually identical structure is shown and described in detail in copending application Ser. Nos. 08/184,247 and 08/184,250 (now U.S. Pat. No. 5,476,294 issued 19 Dec. 1995 and U.S. Pat. No. 5,494,322 issued 27 Feb. 1996, respectively).

More specifically, the lower end of the link 5*b* carries a coupling part or pin 5*b*' which slides in a slot 3*b*' of the guide 3*b* and is engageable with an entrainment tab 3*a*' of the lever 3*a*. The lower end of the lever 4*b* carries a pin 4*b*' which rides in the slot 3*b*' above the pin 5*b*. Thus when the lever 5*a*, which forms the locking mechanism 5 along with the link 5*b*, the lever 14 and pin 5*b*' is in the locked position of FIG. 1, the pin 5*b*' is below the tab 3*a*' and clockwise pivoting of the lever 4*b* will pivot the guide 3*b* and pin 5*b*' counterclockwise, but since the pin 5*b*' is below the tab 3*a*' this pivoting will not be transmitted to the lever 3*a* and the lock will remain latched.

When, however, the lever 5*a* is pivoted somewhat counterclockwise into the unlocked position, the link 5*b* and pin 5*b*' are raised, putting this pin 5*b*' next to the tab 3*a*'. Subsequent clockwise pivoting of the lever 4*b*, which forms with the lever 4*a* and the pin 4*b*' the mechanism 4, will therefore move the pin 5*b*' toward the left so that the lever 3*a* will act on the pin 3*a* and push the pawl 2 down, unlatching the latch and releasing the bolt 8.

The housing 6 seen from above is basically L-shaped with the entire release-lever system 3 and much of the actuating system 4 and locking system 5 in the main part. A perpendicular extension part 6' contains the lever 14 which is connected to a schematically illustrated inside operating button 21 that projects out through a secondary hole 7' in the housing 6, and also contains the lever 4*a* along with an actuating lever 4*c* that projects out through another hole 7" in the housing 6 and that is connected to an outside door handle illustrated schematically at 22. FIG. 1 shows a third actuating lever 4*d* connected to an inside door handle 23 and directly connected to the guide 3*b*, although it could also be directly connected to the release lever 3*a*. Thus in the unlocked position, that is when the tab 3*a*' is in the path of the pin 5*b*' carried on the lower end of the locking link 5*b*, actuation of either handle 22 or 23 will trip the lever 3*a* and unlatch the door. In addition at any time the inside button 21 can be operated to act via the lever 14 on the locking lever 5*a* to raise and lower the link 5*b* and its pin 5*b*' and move the latch between the locked and unlocked positions.

Figure 4:
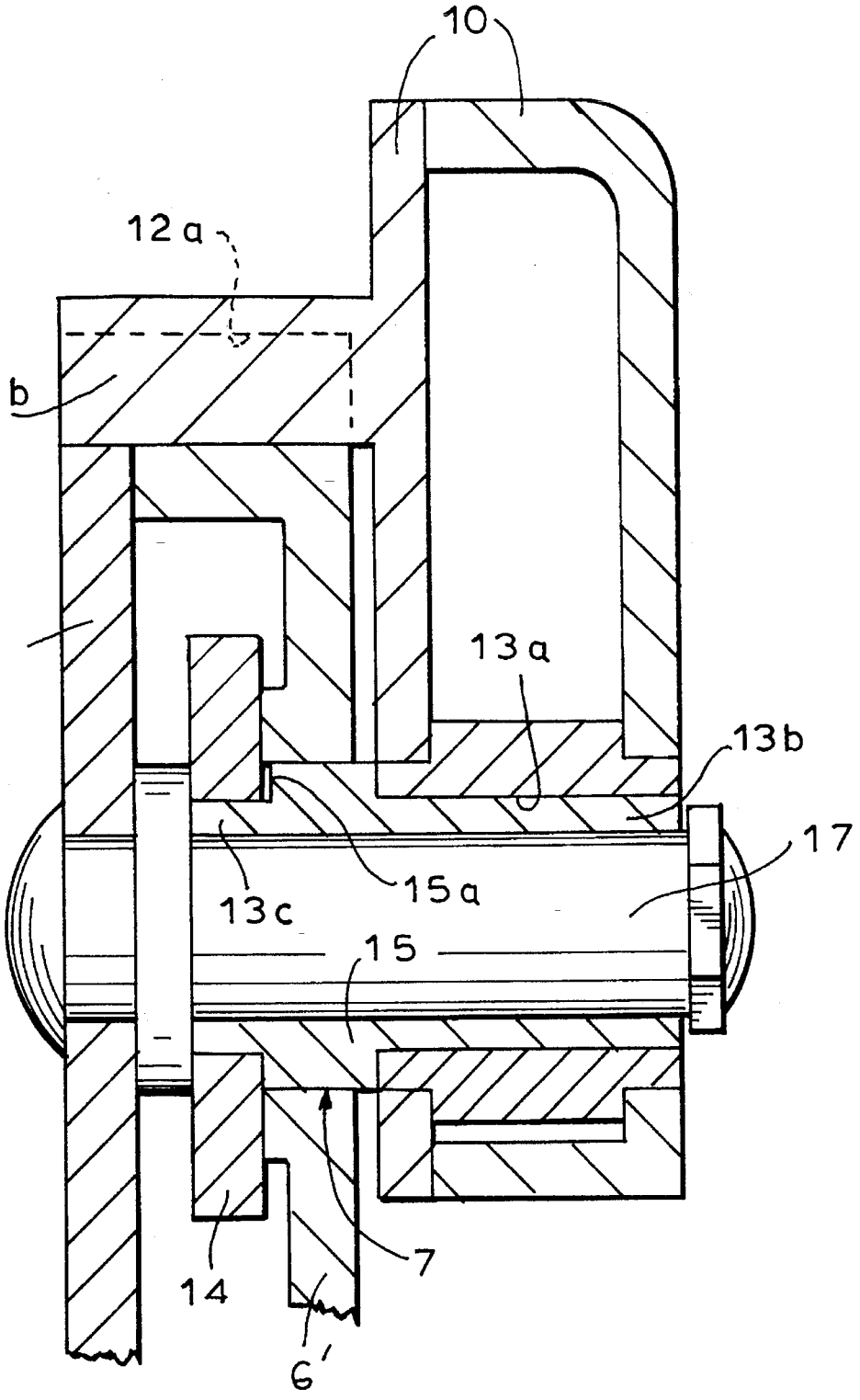
FIG. 4 is a large-scale section taken along line IV—IV of FIG. 3.

According to the invention the main locking lever 14 is mounted as shown in FIG. 4 on a shaft 17 carrying a pivot sleeve 15 having a square-section outer portion 13*b* projecting outside the housing extension 6' and a square-section inner portion 13*c* inside the housing 6 and fitted in and indeed welded to the lever 14. Thus the sleeve 15 pivots jointly with the lever 14.

Figure 3:
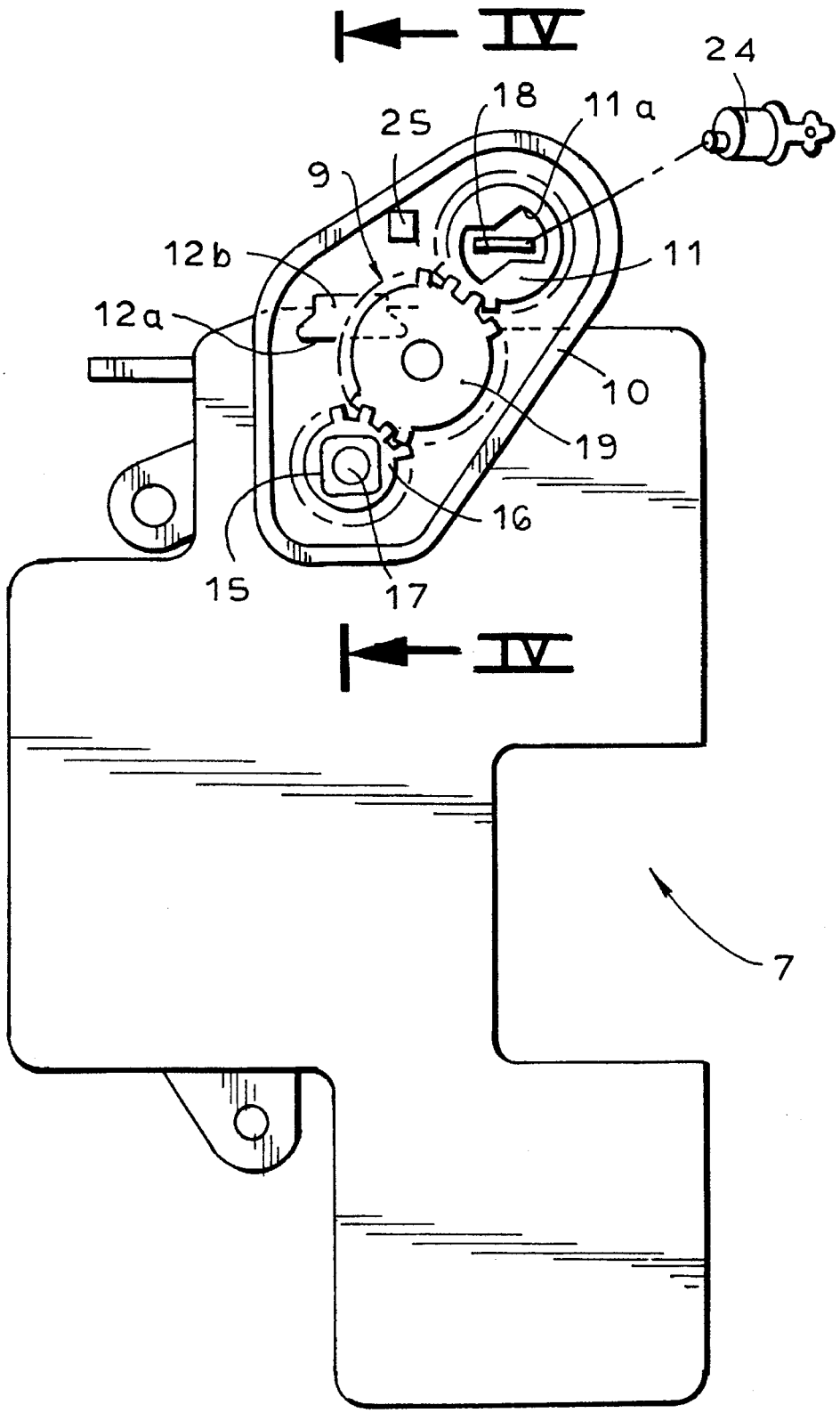
FIG. 3 an end view like FIG. 3 but showing the entire lock with an installed lock-linkage module.

An auxiliary housing 10 is formed with a dovetail projection 12*b* that can fit into a dovetail seat or recess 12*a* on the housing extension 6'. This housing 10 holds as shown in FIG. 3 a gear-train linkage 9 comprising a gear 16 having a socket 13*a* fitted over the square-section end 13*b* of the sleeve shaft 15, an intermediate gear 19, and an end gear 11 mounted on respective pivots on the auxiliary housing 10. The end gear 11 is formed outside the auxiliary housing 10 as a rotatable nut in turned formed with a seat 11*a* in which fits the blade 18 of a key cylinder 24, with the usual angular play to allow the key to be extracted without unlocking the lock when it is locked. A sensor or switch 25 in the auxiliary housing 10 can be connected to an unillustrated central lock system or controller to report to it the position of the linkage 9.

It is therefore possible when using the latch according to the invention on a rear door to dispense completely with the auxiliary housing 10 and its linkage 9. This substantially reduces costs since the unnecessary square-end shaft 15 on the main housing extension 6' is of no significant cost. For use on a front door the housing 10 and its linkage 9 are used, and may be substituted for housings 10 and linkages 9 of different dimensions and construction to accommodate the geometry of different doors. The unit in the housing 6 remains a standard lockable door latch that can be used on front and back doors, even on a trunk lid if necessary, and that can be adapted to differently constructed doors.

We claim:

1. A motor-vehicle door latch comprising:

a main housing;

a lock fork on the main housing engageable with a door bolt and pivotable between a holding position engaged around the bolt and retaining it on the main housing and a freeing position permitting the door bolt to move into and out of the main housing;

a release pawl engageable on the main housing with the fork and displaceable between a latched position retaining the fork in the holding position and an unlatched position unengageable with the fork and permitting the fork to move into the freeing position;

a manual actuating mechanism movable in the main housing between an actuated position and an unactuated position;

means including a coupling part displaceable on the main housing between a coupling position connecting the actuating mechanism to the release pawl for displacement of the release pawl into the unlatched position on displacement of the actuating mechanism into the actuated position and a decoupling position for disconnecting the actuating mechanism from the release pawl, whereby in the decoupling position actuation of the actuating mechanism does not affect the release pawl;

a central locking element on the main housing movable between a locked and an unlocked position;

means including a locking mechanism jointly movable with the locking element and connected between the central locking element and the coupling part for displacing the coupling part into the decoupling position on displacement of the central locking element into the locked position and for displacing the coupling part into the coupling position on displacement of the central locking element into the unlocked position, one of the mechanisms being provided with an externally accessible actuation formation;

an auxiliary housing independent of the main housing;

a linkage in the auxiliary housing having a pair of ends, one of which is formed by a rotatable nut; and means for securing the auxiliary housing on the main housing with one end of the linkage fitted to the actuation formation for operation of the one mechanism via the actuation formation and with the other end of the linkage positioned for connection to an actuating part constituted as a lock cylinder.

2. The motor-vehicle door latch defined in claim 1 wherein the housings have interfitting mounting formations forming the securing means.

3. The motor-vehicle door latch defined in claim 1 wherein the one end of the linkage fits complementarily with the actuation formation.

4. The motor-vehicle door latch defined in claim 1 wherein the linkage is a gear train.

5. The motor-vehicle door latch defined in claim 1 wherein the actuation formation is a noncylindrical shaft part projecting from the main housing along a coupling axis and the one linkage end is shaped to fit complementarily over the shaft part.

6. The motor-vehicle door latch defined in claim 1 wherein the securing means includes complementary formations that interfit parallel to the coupling axis.

7. The motor-vehicle door latch defined in claim 1 wherein the auxiliary housing further contains electrical sensor means.

8. A motor-vehicle door latch comprising:

a main housing;

a lock fork on the main housing engageable with a door bolt and pivotable between a holding position engaged around the bolt and retaining it on the main housing and a freeing position permitting the door bolt to move into and out of the main housing;

a release pawl engageable on the main housing with the fork and displaceable between a latched position retaining the fork in the holding position and an unlatched position unengageable with the fork and permitting the fork to move into the freeing position;

a manual actuating mechanism movable in the main housing between an actuated position and an unactuated position;

means including a coupling part displaceable on the main housing between a coupling position connecting the actuating mechanism to the release pawl for displacement of the release pawl into the unlatched position on displacement of the actuating mechanism into the actuated position and a decoupling position for disconnecting the actuating mechanism from the release pawl, whereby in the decoupling position actuation of the actuating mechanism does not affect the release pawl;

a central locking element on the main housing movable between a locked and an unlocked position;

means including a locking mechanism jointly movable with the locking element and connected between the central locking element and the coupling part for displacing the coupling part into the decoupling position on displacement of the central locking element into the locked position and for displacing the coupling part into the coupling position on displacement of the central locking element into the unlocked position, one of the mechanisms being provided with an externally accessible actuation formation projecting from the main housing along a coupling axis;

an auxiliary housing independent of the main housing;

a linkage in the auxiliary housing having a pair of ends; and meads including a dovetail ridge and a complementary dovetail groove extending parallel to the coupling axis for securing the auxiliary housing on the main housing with one end of the linkage fitted to the actuation formation for operation of the one mechanism via the actuation formation and with the other end of the linkage positioned for connection to an actuating part.

9. The motor-vehicle door latch defined in claim 8 wherein the other end of the linkage is formed by a rotatable nut.

10. The motor-vehicle door latch defined in claim 9 wherein the actuating part is a lock cylinder.

11. A motor-vehicle door latch comprising:

a main housing;

a lock fork on the main housing engageable with a door bolt and pivotable between a holding position engaged around the bolt and retaining it on the main housing and a freeing position permitting the door bolt to move into and out of the main housing;

a release pawl engageable on the main housing with the fork and displaceable between a latched position retaining the fork in the holding position and an unlatched position unengageable with the fork and permitting the fork to move into the freeing position;

a manual actuating mechanism movable in the main housing between an actuated position and an unactuated position;

means including a coupling part on the main housing displaceable between a coupling position connecting the actuating mechanism to the release pawl for displacement of the release pawl into the unlatched position on displacement of the actuating mechanism into the actuated position and a decoupling position for disconnecting the actuating mechanism from the release pawl, whereby in the decoupling position actuation of the actuating mechanism does not affect the release pawl;

a central locking element on the main housing movable between a locked and an unlocked position;

means including a locking mechanism jointly movable with the locking element and connected between the central locking element and the coupling part for displacing the coupling part into the decoupling position on displacement of the central locking element into the locked position and for displacing the coupling part into the coupling position on displacement of the central locking element into the unlocked position, the locking mechanisms being provided with an externally accessible polygonal-section actuation formation;

an auxiliary housing independent of the main housing;

a gear linkage in the auxiliary housing having a pair of end gears;

means for securing the auxiliary housing on the main housing with one end of the end gears fitted to the actuation formation for operation of the locking mechanism via the actuation formation; and a lock cylinder engaged with the other end of the linkage.

* * * * *